US005377829A

United States Patent [19]

Bahl

[11] Patent Number: 5,377,829

[45] Date of Patent: Jan. 3, 1995

[54] FOOTBALL DISPLAY CASE

[76] Inventor: Ronald J. Bahl, 4408 S. 8th St. Terr., Blue Springs, Mo. 64015

[21] Appl. No.: 222,435

[22] Filed: Apr. 4, 1994

[51] Int. Cl.[6] ..... B65D 85/00; A47F 7/00

[52] U.S. Cl. ..... 206/315.9; 206/45.34; 211/14; 312/114

[58] Field of Search ..... 206/315.9, 45.31, 45.34; 40/493; 211/14; 312/114; D11/131, 157; D21/209; 273/55 B

[56] References Cited

U.S. PATENT DOCUMENTS

| | | | |
|---|---|---|---|
| D. 258,125 | 12/1981 | Bailey | D11/157 |
| D. 275,967 | 10/1984 | Moreno, Jr. | D11/157 X |
| 3,231,993 | 2/1966 | Levy | 211/14 X |
| 4,494,650 | 1/1985 | Cullen | 206/45.34 |
| 4,955,485 | 9/1990 | Alton | 211/14 |

*Primary Examiner*—Bryon P. Gehman

[57] ABSTRACT

A football display case comprising a base in a rectangular configuration having an upper surface and a lower surface, the base being sanded, stained and finished with polyurethane; a piece of plywood in a rectangular configuration having an upper and lower surface and glued at its lower surface to the upper surface of the base; a piece of artificial turf in a rectangular configuration having an upper surface and a lower surface and glued at its lower surface to the upper surface of the plywood, the piece of turf having a length and width essentially the same as that of the plywood; four apertures formed in the base, plywood and turf in a rectangular configuration, the four dowels located in the apertures to an extent upwardly for holding a football on the dowels; and an oak frame resting on the base, the frame having a rectangular upper section with an external periphery greater than the plywood and turf but less than the base, the frame also including four vertical posts coupled at their upper ends to the rectangular upper section at its corners and resting at its lower ends upon the turf and base.

3 Claims, 4 Drawing Sheets

FOOTBALL DISPLAY CASE

BACKGROUND OF THE INVENTION

1. Field of the Invention

The present invention relates to new and improved football display cases and more particularly pertains to displaying footballs in a case featuring a frame with plexiglass sheets.

2. Description of the Prior Art

The use of display members for athletic or related items is known in the prior art. More specifically, display members for athletic or related items heretofore devised and utilized for the purpose of displaying articles for view are known to consist basically of familiar, expected, and obvious structural configurations, notwithstanding the myriad of designs encompassed by the crowded prior art which has been developed for the fulfillment of countless objectives and requirements.

The prior art discloses a large number of display members for athletic or related items. By way of example, U.S. Pat. No. 4,223,966 to Winters discloses a glass display case.

U.S. Pat. No. 5,039,002 to Spamer discloses an article display case.

U.S. Pat. No. 5,082,110 to Hager discloses a protective case for collectible baseballs.

U.S. Pat. No. 5,118,171 to Ortiz discloses an award display case.

Lastly, U.S. Pat. No. 291,850 to Perkins discloses a display case for miniature sports headgear.

In this respect, football display cases according to the present invention substantially depart from the conventional concepts and designs of the prior art, and in doing so provide an apparatus primarily developed for the purpose of displaying footballs in a case featuring a frame with plexiglass sheets.

Therefore, it can be appreciated that there exists a continuing need for new and improved football display cases which can be used for displaying footballs in a case featuring a frame with plexiglass sheets. In this regard, the present invention substantially fulfills this need.

SUMMARY OF THE INVENTION

In view of the foregoing disadvantages inherent in the known types of display members for athletic or related items now present in the prior art, the present invention provides new and improved football display cases. As such, the general purpose of the present invention, which will be described subsequently in greater detail, is to provide new and improved football display cases and methods which have all the advantages of the prior art and none of the disadvantages.

To attain this, the present invention essentially comprises a new and improved football display case comprising, in combination, a base in a rectangular configuration having an upper surface and a lower surface and measuring about fifteen inches long, eleven inches wide and twelve and a half inches thick, the base being sanded, stained and finished with polyurethane; a piece of plywood in a rectangular configuration having an upper and lower surface and glued at its lower surface to the upper surface of the base, the plywood measuring twelve inches long by eight inches wide and one-eighth inch thick; a piece of artificial turf in a rectangular configuration having an upper surface and a lower surface and glued at its lower surface to the upper surface of the plywood, the piece of turf having a length and width essentially the same as that of the plywood; four apertures about a fourth inch in diameter formed in the base, plywood and turf in a rectangular configuration, the four dowels being about one and a half inches in length and about one-fourth inch in diameter located in the apertures to an extent upwardly for holding a football on the dowels; an oak frame resting on the base, the frame having a rectangular upper section with an external periphery greater than the plywood and turf but less than the base, the frame also including four vertical posts coupled at their upper ends to the rectangular upper section at its corners and resting at its lower ends upon the turf and base; and plexiglass sheets positioned horizontally between the upper section of the frame and vertically between the posts and upper section of the frame to encompass a ball located on the dowels, the frame having recesses in the upper section and posts for receiving the upper and lateral edges of the plexiglass sheets.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved football display cases which have all the advantages of the prior art display members for athletic or related items and none of the disadvantages.

It is another object of the present invention to provide new and improved football display cases which may be easily and efficiently manufactured and marketed.

It is a further object of the present invention to provide new and improved football display cases which are of a durable and reliable construction.

An even further object of the present invention is to provide new and improved football display cases which are susceptible of a low cost of manufacture with regard to both materials and labor, and which accordingly are then susceptible of low prices of sale to the consuming public, thereby making such football display cases economically available to the buying public.

Still yet another object of the present invention is to provide new and improved football display cases which provide in the apparatuses and methods of the prior art some of the advantages thereof, while simultaneously overcoming some of the disadvantages normally associated therewith.

Even still another object of the present invention is to display footballs in a case featuring a frame with plexiglass sheets.

Lastly, it is an object of the present invention to provide a football display case comprising a base in a rectangular configuration having an upper surface and a lower surface, the base being sanded, stained and finished with polyurethane; a piece of plywood in a rectangular configuration having an upper and lower surface and glued at its lower surface to the upper surface of the base; a piece of artificial turf in a rectangular configuration having an upper surface and a lower surface and glued at its lower surface to the upper surface of the plywood, the piece of turf having a length and width essentially the same as that of the plywood; four apertures formed in the base, plywood and turf in a rectangular configuration, the four dowels located in the apertures to an extent upwardly for holding a football between the dowels; and an oak frame resting on the base, the frame having a rectangular upper section with an external periphery greater than the plywood and turf but less than the base, the frame also including four vertical posts coupled at their upper ends to the rectangular upper section at its corners and resting at its lower ends upon the turf and base.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
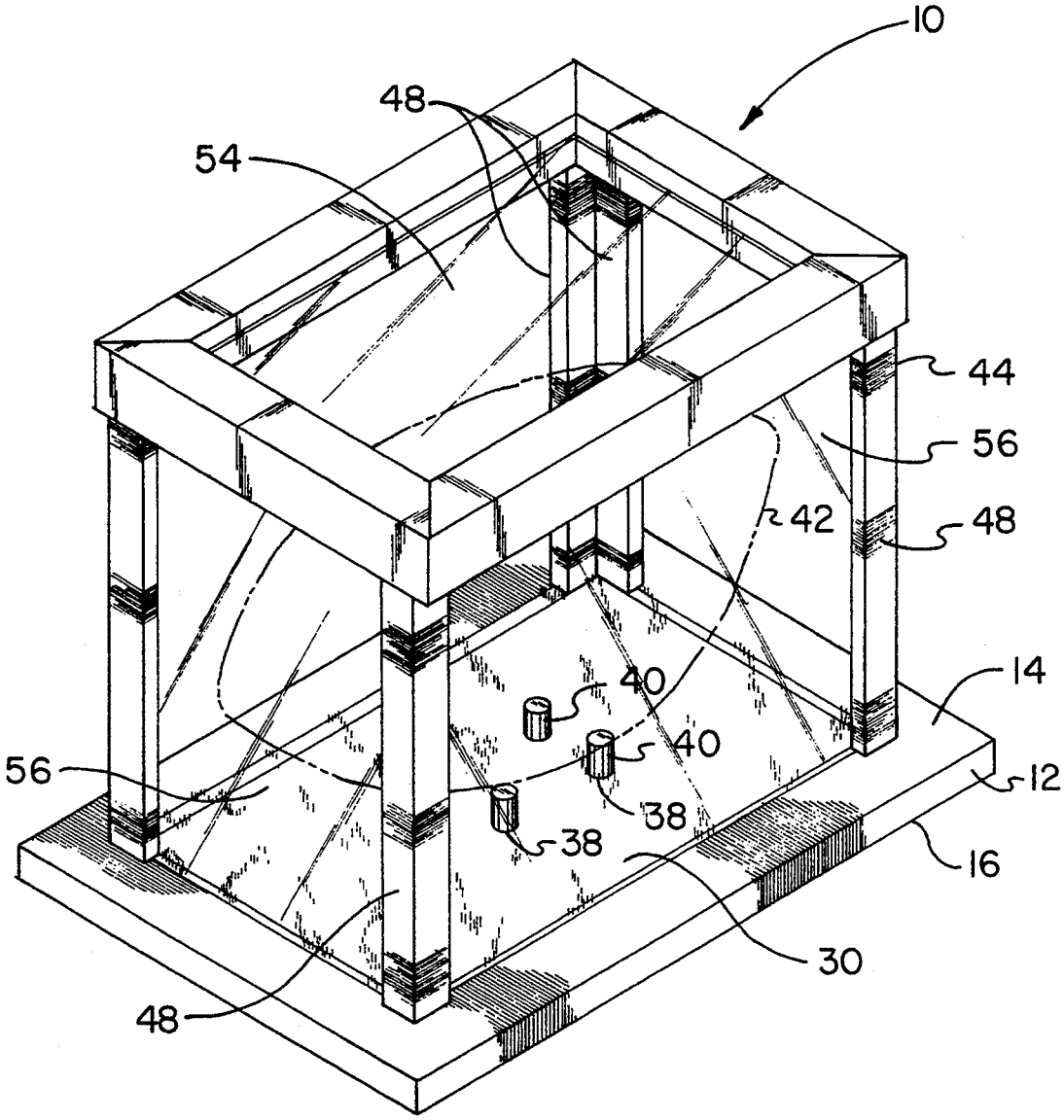
FIG. 1 is a perspective illustration of the preferred embodiment of the football display case constructed in accordance with the principles of the present invention.
Figure 2:
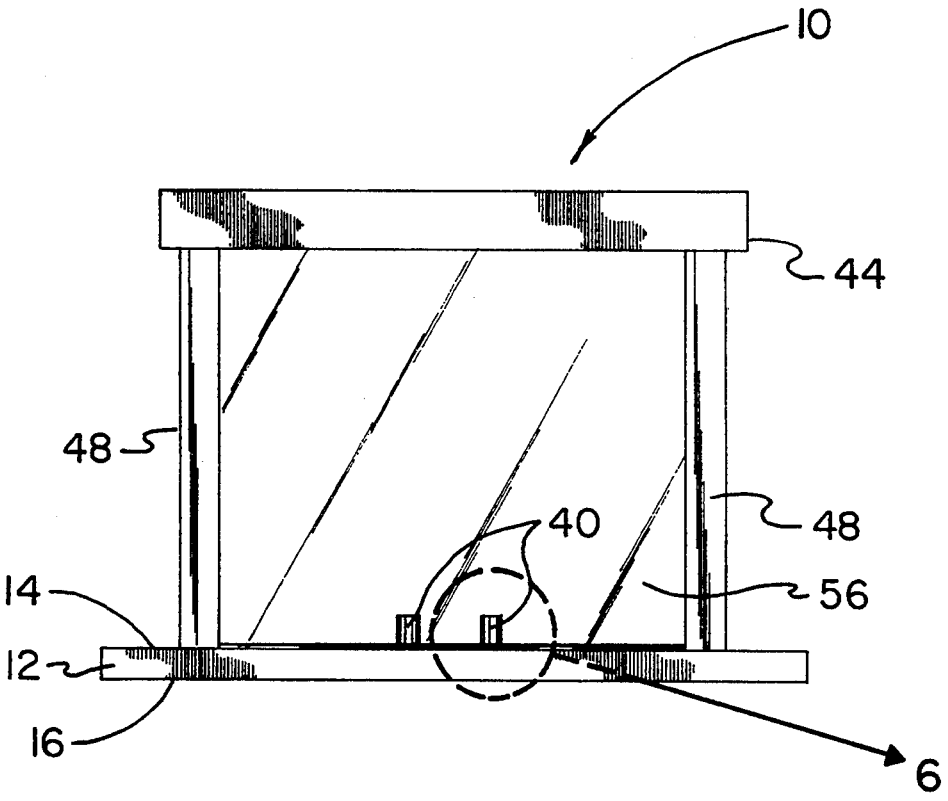
FIG. 2 is a front elevational view of the display case shown in FIG. 1.
Figure 3:
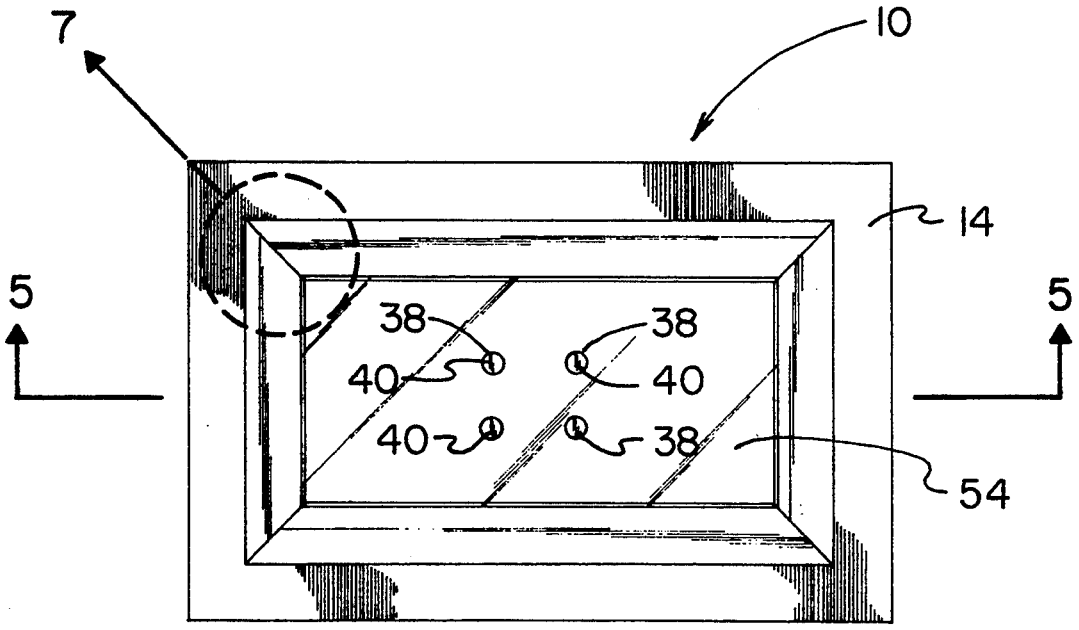
FIG. 3 is a top plan view of the display case shown in FIGS. 1 and 2.
Figure 4:
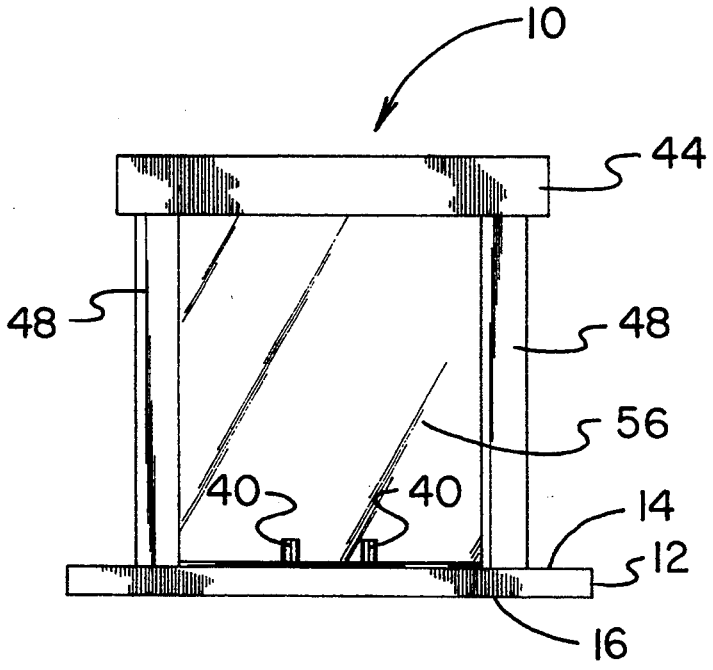
FIG. 4 is a side elevational view of the display case shown in the prior figures.
Figure 5:
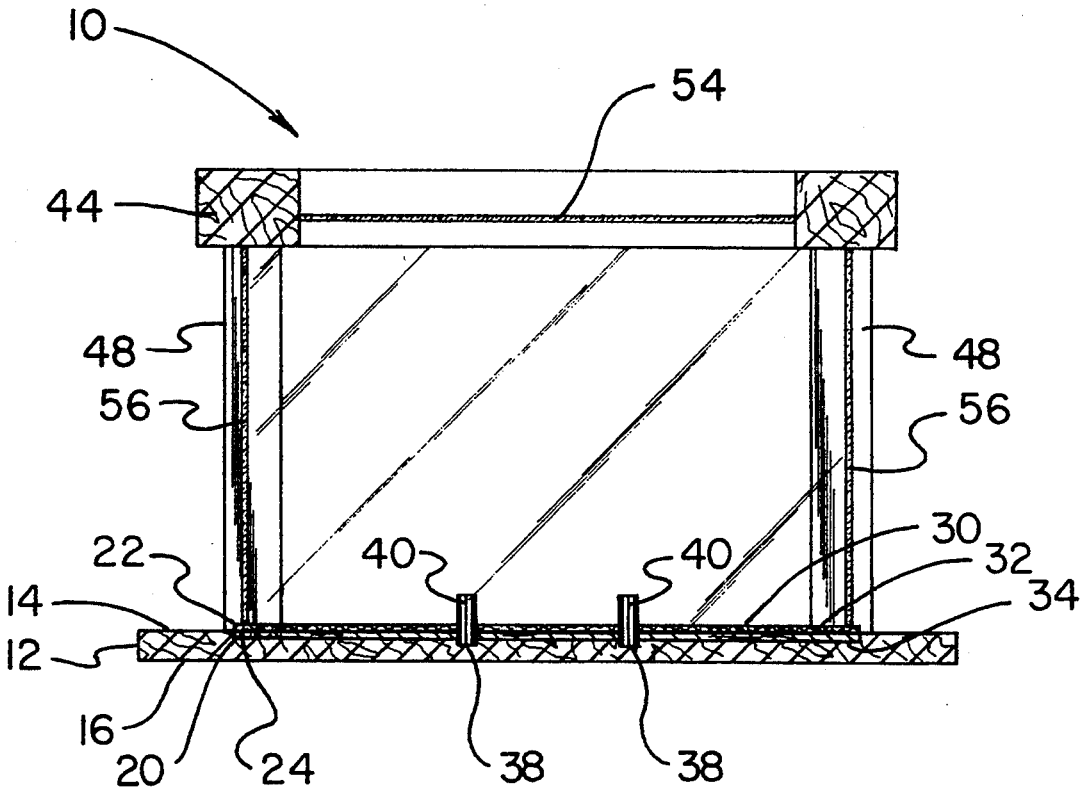
FIG. 5 is a cross sectional view taken along line 5—5 of FIG. 3.
Figure 6:
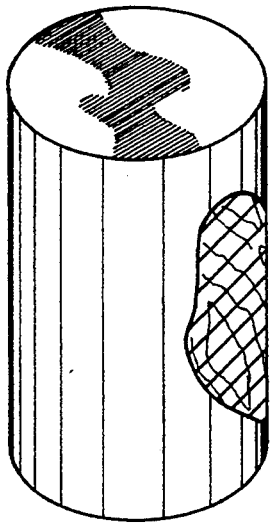
FIG. 6 is a perspective view of one of the dowels with parts broken away to show internal constructions taken about circle 6 of FIG. 2.
Figure 7:
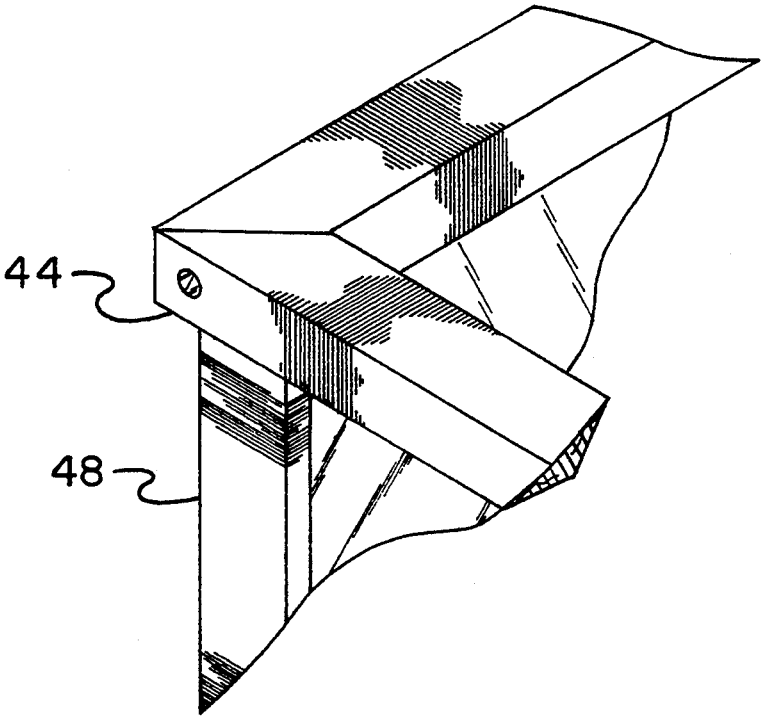
FIG. 7 is an enlarged perspective view of one corner of the display case of the prior figures taken about circle 7 of FIG. 3.

With reference now to the drawings, and in particular to FIGS. 1 through 7 thereof, the preferred embodiment of the new and improved football display case embodying the principles and concepts of the present invention and generally designated by the reference numeral 10 will be described.

Specifically, the present invention is comprised of a plurality of components. In their broadest context such components include a base, plywood, artificial turf, a frame and plexiglass sheets. Such components are individually configured and correlated with respect to each other so as to attain the desired objectives.

More specifically, the base 12 is a rectangular member. It has upper and lower surfaces 14 and 16. The base measures about fifteen inches long by about eleven inches wide. It has a thickness of about one-half inch. Prior to use, the base is sanded, stained with an appropriate stain and finished with a finishing agent, preferably polyurethane.

On top of the base is a piece of plywood 20. The plywood measures about twelve inches long, eight inches wide and about one-eighth inch thick. The plywood has an upper surface 22 and a lower surface 24. The lower surface of the plywood is secured to the upper surface of the base through glue. It is centrally positioned on the base.

Next provided is a piece of artificial turf 30. The artificial turf has an upper surface 32 and a lower surface 34. The plywood has a length and width essentially equal to that of the plywood. It is adapted to have its lower surface secured to the upper surface of the plywood with glue.

Next provided are four apertures 38. The apertures are about one-fourth inch in diameter and extend through the turf, plywood and base. They extend downwardly about three-fourths of an inch. They are positioned on the surfaces of the turf, plywood and base in a rectangular configuration for receiving dowels 40 which support a football 42. The dowels each measure about one and a half inches in length and about one-fourth inch in diameter. Their length allows about half of their length to be exposed above the surface of the plywood.

Next provided is a frame 44 adapted to rest on the base. The frame is fabricated of oak in a rectangular configuration. The frame has a rectangular upper section with its external periphery being greater than the external periphery of the plywood and turf. The external periphery of the upper section of the frame is less than the periphery of the base.

The frame also includes vertically extending posts 48. Such posts are preferably four in number and are coupled as by glue at their upper ends to the lower surface of the rectangular upper section of the frame. The posts rest at their lower ends on the turf and base. In this manner, the frame may be readily lifted from the base to expose the football or to expose the dowels for placing a football thereon or thereof. The frame is preferably formed of oak sanded, stained and finished with polyurethane as the base.

The last component of the system are the plexiglass sheets 54 and 56. Such sheets include a horizontal sheet and four vertical sheets. Such sheets include the horizontal sheet positioned horizontally within the upper section of the base. The vertical sheets are positioned within the frame with their upper edges coupled with respect to the lower surface of the upper section of the frame and with their lateral edges secured to the upper section of the frame horizontally and the adjacent edges of the posts. Coupling is through recesses 58 formed in the lower surface of the upper section of the frame as well as the facing surfaces of the post. Glue 60 secures the upper and lateral edges of the vertical plexiglass sheets with respect to the frame.

The present invention is a wood and plexiglass display case for a football. It can be used by schools, professional teams and individuals to display a game ball from a memorable contest such as a championship victory, All-Star game or other occasion. There are a large number of footballs displayed throughout the country. The present invention enable these footballs to be shown in a most attractive manner.

The present invention features an oak base measuring 15 inches long by 11 inches wide by ½ inch thick. The base is sanded, stained with an appropriate stain and finished with polyurethane. On top of the base is glued a piece of plywood measuring 12 inches by 8 inches by ⅛ inch. In turn, a piece of Astroturf having the same length and width as the plywood is glued to the top of it.

Four dowels are mounted at the center of the Astroturf surface. Their dimensions are 1½ inches long and ¼ inch in diameter and are red in color. The purpose of the dowels is to support the football.

An oak frame rests on the base and fits around the football on the top and the sides. Uprights are glued or stapled on the inside of the frame. In addition, plexiglass panels are used on the four sides and the top to ensure that the ball can be viewed conveniently yet protected from dust and people touching it. If someone should want to get to the ball for some reason, the frame can easily be lifted off of the base.

Natural wood construction, attractive design and ease of use are all features that make the present invention very appealing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved football display case comprising, in combination:

a base in a rectangular configuration having an upper surface and a lower surface and measuring about fifteen inches long, eleven inches wide and twelve and a half inches thick, the base being sanded, stained and finished with polyurethane;

a piece of plywood in a rectangular configuration having an upper and lower surface and glued at its lower surface to the upper surface of the base, the plywood measuring twelve inches long by eight inches wide and one-eighth of an inch thick;

a piece of artificial turf in a rectangular configuration having an upper surface and a lower surface and glued at its lower surface to the upper surface of the plywood, the piece of turf having a length and width substantially the same as that of the plywood;

four apertures about one-fourth of an inch in diameter formed in the base, plywood and turf the four apertures arranged to define a rectangular configuration, a dowel being about one and a half inches in length and about one-fourth of an inch in diameter located in each of the apertures to an extent for holding a football on the dowels above the artificial turf;

an oak frame resting on the base, the frame having a rectangular upper section with an external periphery greater than the plywood and turf but less than the base, the frame also including four vertical posts, each post coupled at its upper end to the rectangular upper section at one of the upper section corners and resting at its lower end upon the turf and base; and plexiglass sheets positioned horizontally between the upper section of the frame and vertically between the posts and upper section of the frame to encompass a ball located on the dowels, the frame having recesses in the upper section and posts for receiving the upper and lateral edges of the plexiglass sheets.

2. A football display case comprising:

a base in a rectangular configuration having an upper surface and a lower surface, the base being sanded, stained and finished with polyurethane;

a piece of plywood in a rectangular configuration having an upper and lower surface and glued at its lower surface to the upper surface of the base;

a piece of artificial turf in a rectangular configuration having an upper surface and a lower surface and glued at its lower surface to the upper surface of the plywood, the piece of turf having a length and width substantially the same as that of the plywood;

four apertures formed in the base, plywood and turf, the four apertures arranged to define rectangular configuration, a dowel located in the apertures to an extent for holding a football on the dowels above the artificial turf; and an oak frame resting on the base, the frame having a rectangular upper section with an external periphery greater than the plywood and turf but less than the base, the frame also including four vertical posts, each post coupled at its upper end to the rectangular upper section at one of the upper section corners and resting at its lower end upon the turf and base.

3. The football display case as set forth in claim 2 and further including:

plexiglass sheets positioned horizontally between the upper section of the frame and vertically between the posts and upper section of the frame to encompass a ball located on the dowels, the frame having recesses in the upper section and posts for receiving the upper and lateral edges of the plexiglass sheets.

* * * * *